US007063020B2

(12) United States Patent
Eches et al.

(10) Patent No.: US 7,063,020 B2
(45) Date of Patent: Jun. 20, 2006

(54) PERFORATING AMMUNITION

(75) Inventors: Nicolas Eches, Plaimpied (FR); Dominique Bouchaud, Bourges (FR)

(73) Assignee: GIAT Industries, Versailles (FR)

( * ) Notice: Subject to any disclaimer, the term of this patent is extended or adjusted under 35 U.S.C. 154(b) by 15 days.

(21) Appl. No.: 10/948,232

(22) Filed: Sep. 24, 2004

(65) Prior Publication Data

US 2005/0109233 A1 May 26, 2005

(51) Int. Cl.
*F42B 12/58* (2006.01)

(52) U.S. Cl. ..... 102/489; 102/496; 102/518

(58) Field of Classification Search ..... 102/489, 102/492, 496, 500, 394, 497, 518, 519
See application file for complete search history.

(56) References Cited

U.S. PATENT DOCUMENTS 3,203,349 A 8/1965 Schonberg ..... 102/52
3,464,356 A * 9/1969 Wasserman et al. ..... 102/489
3,731,630 A * 5/1973 Muller ..... 102/518
4,108,072 A 8/1978 Trinks et al. ..... 102/52
4,573,412 A * 3/1986 Lovelace et al. ..... 102/374
4,597,333 A * 7/1986 Bocker et al. ..... 102/518

FOREIGN PATENT DOCUMENTS

DE 90 18 051 5/1994
FR 2 771 496 5/1999

* cited by examiner

*Primary Examiner*—Michael J. Carone
*Assistant Examiner*—Stewart Knox
(74) *Attorney, Agent, or Firm*—Steptoe & Johnson LLP

(57) ABSTRACT

A perforating ammunition having a penetration body delimiting an internal cavity closed by a base which penetration body includes a front nose with at least one insert integral with the nose, the insert being a material denser than that of the body and arranged in a housing opening to the outside of the body.

13 Claims, 5 Drawing Sheets

PERFORATING AMMUNITION

BACKGROUND OF THE INVENTION

1. Field of the Invention

The technical scope of the invention is that of ammunition able to destroy targets heavily protected by a wall, for example of concrete.

2. Description of the Related Art

It is known, namely by U.S. Pat. No. 6,186,072 to define a piece of ammunition incorporating a perforating body whose inertia ensures its passage through thick protective walls. This ammunition encloses an explosive or incendiary charge that is ignited during perforation or after perforation of the wall.

The perforating body of this ammunition incorporates a solid insert embedded in the material forming the body.

This insert is made of a dense and mechanically strong alloy, chosen, for example among the refractory materials and their alloys (tungsten, tantalum, uranium).

The material forming the body is constituted by steel cast around an insert.

This ammunition has the drawback of being complicated to manufacture. It is firstly tricky and costly to produce a large diameter (over 90 mm), dense core which has high mechanical properties (density of over 13, limit of elasticity of over 1000 Mega Pascals) in a reproducible manner. Indeed, these materials are implemented in powder form using compression techniques.

Secondly, it is costly to cast a steel body around such a core, whose mechanical characteristics risk being deteriorated by the casting operation.

In fact, the material of the insert described in U.S. Pat. No. 6,186,072 fulfils only a ballast function and does not have any true perforating capacity.

SUMMARY OF THE INVENTION

It is the purpose of the invention to propose a perforating ammunition that does not suffer from such drawbacks.

Thus, the ammunition according to the invention is of an easier manufacture.

Moreover, the ammunition according to the invention enables the perforation of a concrete-armored target whatever the angle of impact on the target.

Thus, the invention relates to a perforating ammunition comprising a penetration body delimiting an internal cavity closed by a base, ammunition wherein the penetration body is made of a material having a limit of elasticity greater than or equal to 1200 Mega Pascals and incorporates a front nose comprising at least one insert integral with the nose, insert made of a material with high mechanical properties, denser than that of the body and arranged in a housing opening outside of the body.

According to a first embodiment of the invention, the inserts are organized into segments arranged radially around an axial extension of the body, such segments being made integral with the body by linking means.

The linking means may comprise at least one ring surrounding the inserts.

This perforating ammunition may also comprise a nose made of a dense alloy arranged at the end of the axial extension of the body and incorporating a rear surface pressing on the segments.

According to another embodiment of the invention, each insert may be constituted by a substantially cylindrical bar housed in a bore of the penetration body.

The perforating ammunition may thus comprise a single axial insert comprising a front nose extending the penetration body.

This ammunition may then comprise a propellant powder charge enabling the insert to be ejected out of the penetration body.

According to another embodiment, the ammunition may comprise at least one crown of bars evenly spaced around an axis of the penetration body.

It may thus comprise two crowns of bars evenly spaced around an axis of the penetration body.

The ends of the bars may be flush with an external surface of the penetration body.

The ends of the bars may, on the contrary, project out of the penetration body.

Each bar may have its axis inclined with respect to the axis of the penetration body.

The ends of the bars of a crown and another crown and/or an axial bar may lie substantially in the same plane.

The internal cavity may enclose at least one explosive charge.

BRIEF DESCRIPTION OF THE DRAWINGS

The invention will become more apparent from the following description of the different embodiments, such description made with reference to the appended drawings, in which.

DETAILED DESCRIPTION OF PREFERRED EMBODIMENTS

Figure 1A:
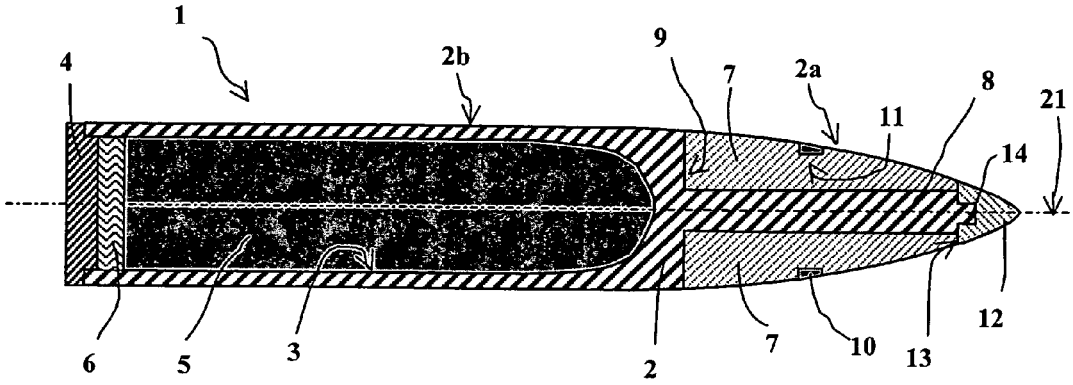
FIGS. 1*a* and 1*b* show a first embodiment of a piece of ammunition according to the invention, FIG. 1*a* being a longitudinal section and FIG. 1*b* an external non-sectioned view of this ammunition.
Figure 1B:
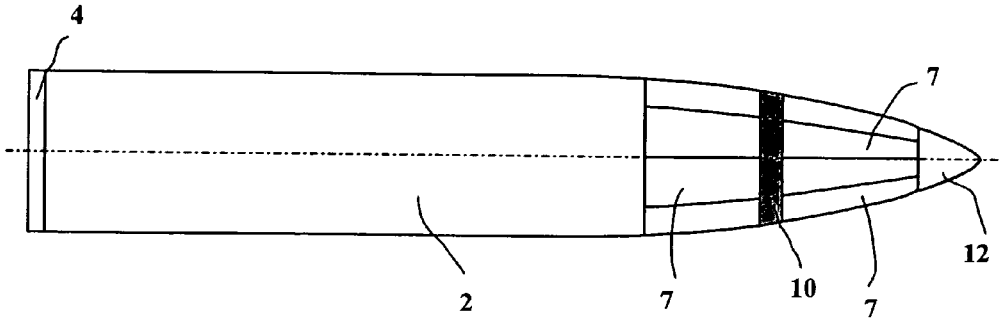

With reference to FIGS. 1*a* and 1*b*, a piece of perforating ammunition 1 according to one embodiment of the invention comprises a penetration body 2 delimiting an internal cavity 3 closed by a base 4.

This ammunition may be an air-to-ground bomb or else a missile or a missile warhead. It will be of a diameter of over 100 mm and a length of around 1.5 m.

According to operational needs, it may comprise a rear part (not shown) incorporating a propellant imparting a given range and velocity to it.

It may also, where need be, comprise a guiding/piloting module.

The internal cavity 3 encloses an explosive charge 5 able to be ignited by a fuse 6 placed in the vicinity of the base 4.

The fuse will be designed so as to ensure the detection of passage through a wall and then to ignite the explosive charge once passage has been made through this wall. Such fuses are well known to the Expert. Reference may be made, for example, to U.S. Pat. No. 5,255,608, which describes such a fuse.

The penetration body 2 comprises a front nose 2*a* extended by a rear cylindrical part 2*b* delimiting the internal cavity 3.

This body is made of a material with high mechanical properties, that is, a material whose limit of elasticity is greater than or equal to 1200 Mega Pascals. 35NCD16 type steel may be used, for example.

According to the invention, the front nose 2*a* comprises inserts 7 made of a denser material than that of the body 2. These inserts are made of a dense material with high mechanical properties. A material with a density of 17 or more having a limit of elasticity greater than or equal to 1000 Mega Pascals will be chosen. A tungsten alloy with a high limit of elasticity obtained by sintering may, for example, be used. The bars may also be made of depleted uranium or tantalum.

The inserts 7 are here in the form of segments arranged around a cylindrical axial extension 8 of the body 2.

Thus, each segment is in contact with the body 2, firstly at the axial extension 8 and secondly with a shoulder 9 of the body 2. The free space surrounding the axial extension 8 thus constitutes a housing for the inserts.

Each insert 7 is also in contact with two other adjacent inserts. The insert assembly thus forms the nose cone part of the front nose 2*a* of the penetration body 2.

The inserts 7 are made integral with the body by a linking means comprising at least one ring 10 surrounding the inserts 7. This ring will be made of steel. It will be housed in a groove 11 formed by the juxtaposition of notches on each insert.

The ammunition 1 also incorporates a nose 12 also made of a dense alloy. This nose is fastened at one end 14 of lesser diameter carried by the axial extension 8 of the body 2. The nose 12 comprises a rear surface 13 pressing on the inserts 7.

The nose 12 is fastened on end 14, for example, by threading. It enables the shock upon impacting a target to be transferred to the different inserts 7.

Thus, the ammunition according to the invention associates a nose cone of substantial diameter (over 90 mm) having a high perforating capability with a steel body whose only purpose is to carry the explosive charge and hold the perforating inserts together.

The inserts are reasonable in dimension (sections being of around 2000 $mm^2$ to 6000 $mm^2$) enabling them to be manufactured using sintering techniques already implemented for artillery fin-stabilized projectiles.

Thanks to the design of the ammunition according to the invention, it is also possible to improve a piece of ammunition after a phase in storage by replacing the inserts 7 initially provided by inserts having improved mechanical properties.

Figure 2:
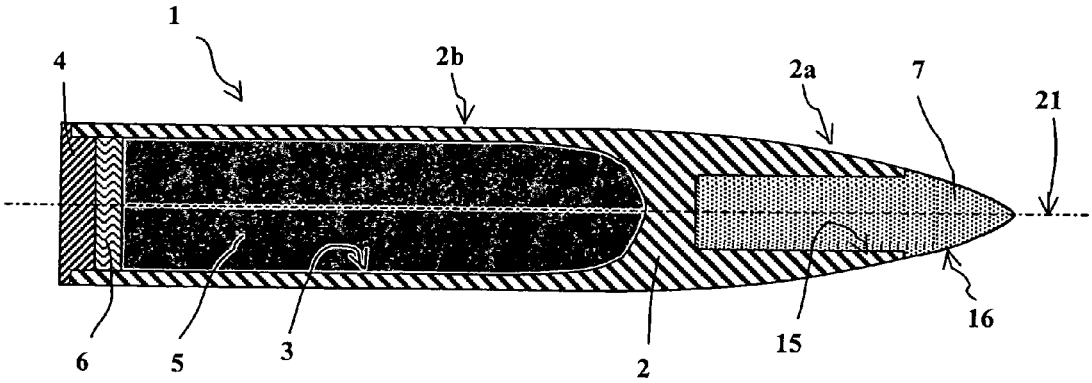
FIG. 2 shows a second embodiment of a piece of ammunition according to the invention.

FIG. 2 shows a piece of ammunition according to another embodiment of the invention.

This embodiment differs from the previous one only in the structure of the front nose 2*a*.

Here, the front nose 2*a* comprises an axial bore 15 inside which an insert 7 is positioned that is in the form of a substantially cylindrical bar made of a denser material than that of the body 2.

The front nose 16 of this insert is cone-shaped that extends the penetration body 2.

This insert 7 will thus have a diameter of around 30 to 40 mm for a penetration body of a diameter of 90 mm. Its manufacture is thereby made easier. The implementation of a tungsten alloy with high mechanical properties (limit of elasticity greater than or equal to 1000 Mega Pascals) enables this nose to be given perforating properties rather than being used simply as ballast. The perforating capabilities of the ammunition are thus improved for a given mass.

Figure 3:
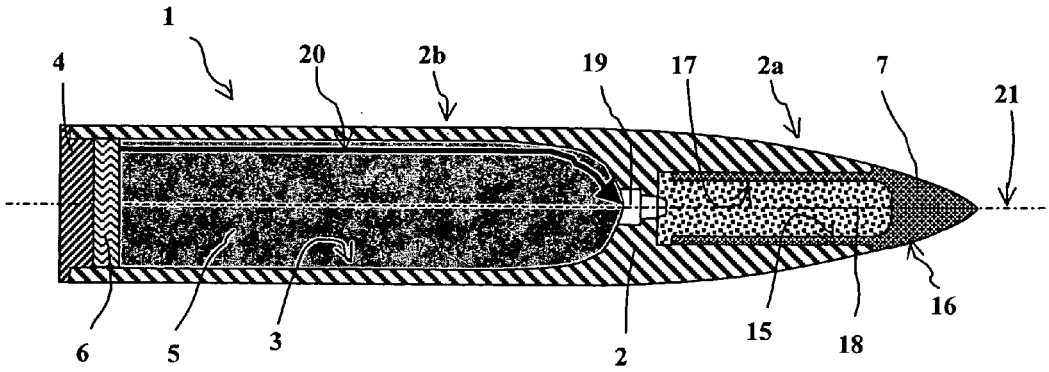
FIG. 3 shows a third embodiment of a piece of ammunition according to the invention.

The ammunition shown in. FIG. 3 also comprises a single insert 7 of a dense material placed in an axial bore 15.

This insert 7 comprises an internal cavity 17 inside which a propellant powder charge 18 is arranged.

A device 19 enabling the ignition of this charge is housed in the body 2. It is connected by a wire link 20 to the fuse 6.

The latter will then incorporate a timer module or a proximity detection module (connected to an antenna not shown integral with the nose cone of the body 2) which will enable the ignition of the propellant charge 18 to be triggered before impacting on a target and at a distance from said target of around 3 to 4 calibers.

The propellant charge 18 will ensure the ejection of the insert 7 out of the penetration body 2. It will thus be propelled towards the target. The speed differential between the insert 7 and the body 2 will be of around 200 m/s. Such an arrangement enables the perforation capabilities of the ammunition to be improved without necessarily increasing its velocity.

The insert will ensure the piercing of an initial hole in the target, the penetration body will then impact the target in this initial hole.

Figure 4A:
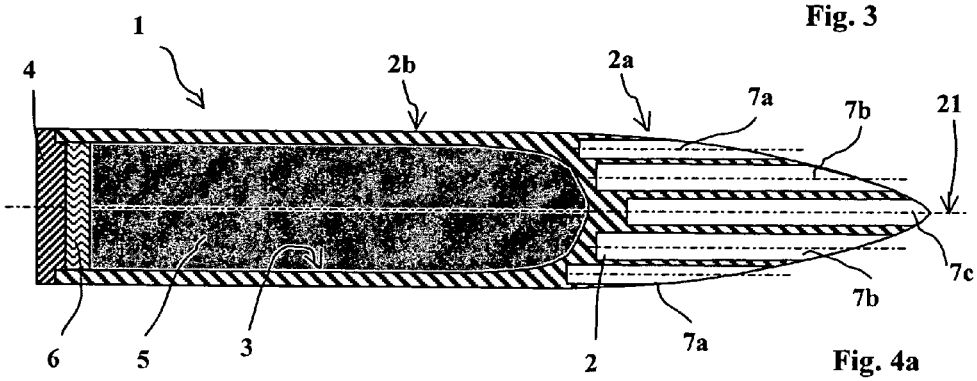
FIGS. 4*a*, 4*b* and 4*c* show a fourth embodiment of a piece of ammunition according to the invention, FIG. 4*a* being a longitudinal section, FIG. 4*b* a non-sectioned external view of this ammunition and FIG. 4*c* a front view of the nose cone of this ammunition.
Figure 4B:
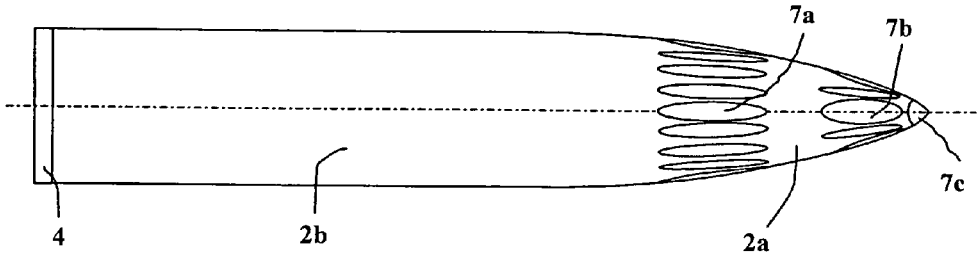
Figure 4C:
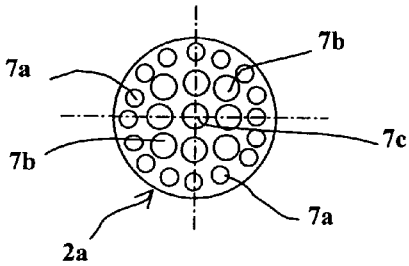

FIGS. 4*a*, 4*b* and 4*c* show another embodiment of a perforating ammunition according to the invention.

This embodiment differs from the previous ones only in the structure of its perforating head 2*a* which here comprises several bars 7*a*, 7*b*, 7*c* crimped into bores arranged in the body of the nose 2*a*.

Each bar 7*a*, 7*b*, 7*c* is cylindrical and the axis of its bore is parallel to the axis 21 of the perforating head 2*a*.

Bars 7*a* and 7*b* are thus split into two concentric crowns surrounding the axis 21 of the perforating head. A bar 7*c*, moreover, occupies a bore coaxial to the head 2*a* (see also FIG. 4*c*).

Around the axial bar 7*c* there is thus a first crown or median crown comprising eight bars 7*b* evenly spaced around the axis 21 and a second crown or external crown comprising sixteen bars 7*a* evenly spaced around the axis 21.

The diameters of the peripheral bars 7*a* are here smaller than those of the median bars 7*b*. The diameters of the different bars may be identical or different according to the organization of the perforating head. The aim is to obtain the high global density for the perforating head. The diameters of the bars may be between 10 mm and 30 mm.

The ends of the different bars are machined such that they are flush with an external cone-shaped surface of the front nose 2*a* (see FIGS. 4*a* and 4*b*) of the penetration body 2. Thus, the bars 7 do not adversely affect the aerodynamism of the ammunition 1.

Once again, the bars are made of a dense material, for example a tungsten alloy obtained by sintering. Because of the reduced diameter of the bars, a material having even higher mechanical properties may be adopted, for example a tungsten alloy whose limit of elasticity is greater than or equal to 1500 Mega Pascals. The body of the head 2*a* is made of steel.

This embodiment enables a front nose 2*a* with a high density to be easily obtained. It is, in fact, easier to produce dense bars of reduced diameter (of around 10 mm to 30 mm) than to produce a front nose of large diameter (over 150 mm) of such a sintered material.

Moreover, it would be tricky to manufacture an ammunition body 2 made entirely of sintered tungsten and comprising a solid front part connected to a thin rear part delimiting a cavity 3.

It is naturally possible for a different number and arrangement to be envisaged for the bars.

Figure 5A:
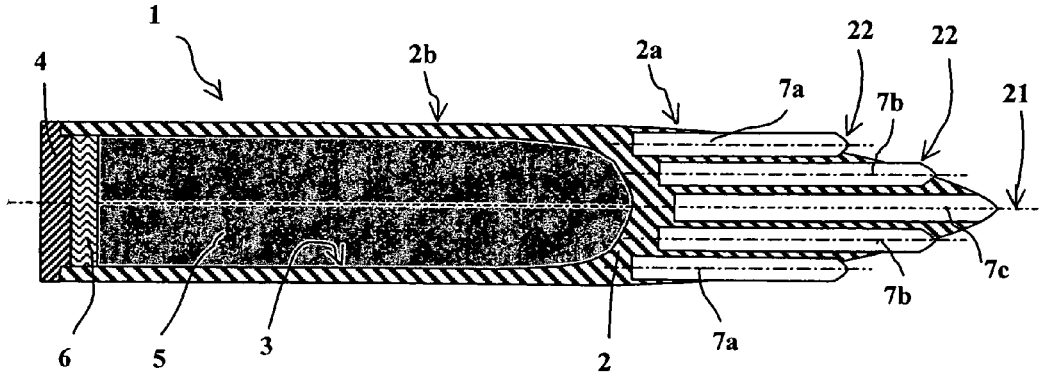
FIGS. 5*a* and 5*b* show a variant of this fourth embodiment, FIG. 5*a* being a longitudinal section and FIG. 5*b* a non-sectioned external view of this ammunition.
Figure 5B:
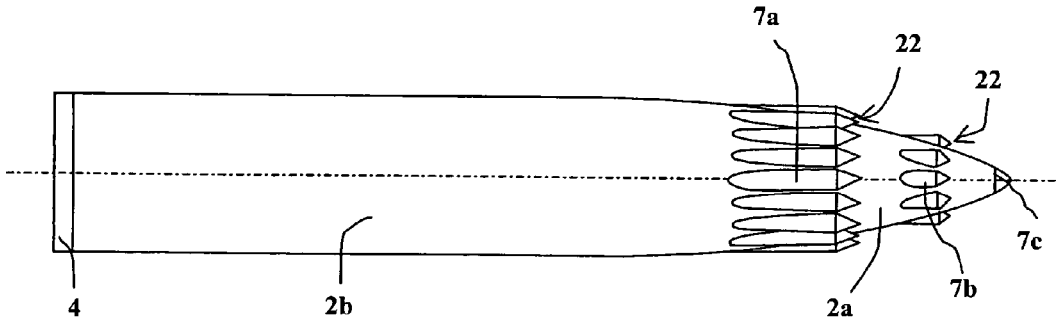

FIGS. 5*a* and 5*b* show another embodiment which differs from the previous one only in the shape of the bars 7.

According to this embodiment, the ends of bars 7*a* and 7*b* protrude outside the penetration body 2. Each bar thus comprises a nose 22 extending out of the cone-shaped external surface of the front nose 2*a*.

This results in a higher engaging capacity of the front nose 2*a* during impact upon a target at an incidence.

The axes of bars 7*a*, 7*b* and 7*c* are, once again, all parallel with axis 21 of the ammunition.

Figure 6A:
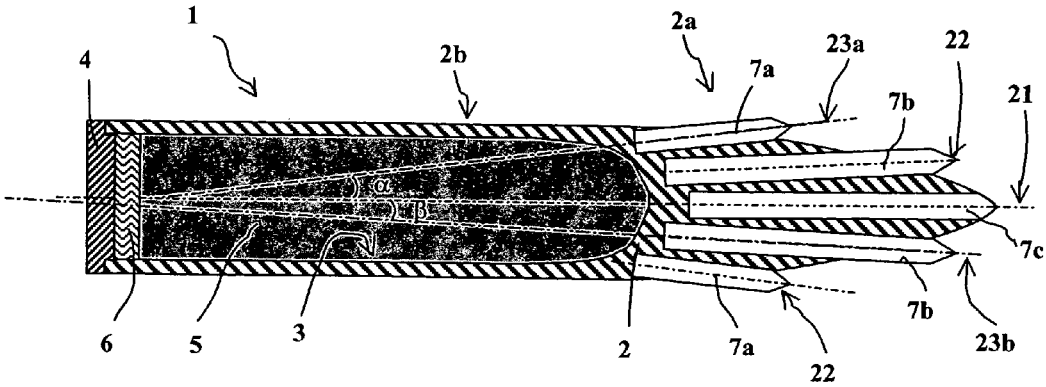
FIGS. 6*a* and 6*b* show another variant of this fourth embodiment, FIG. 6*a* being a longitudinal section and FIG. 6*b* a non-sectioned external view of this ammunition.
Figure 6B:
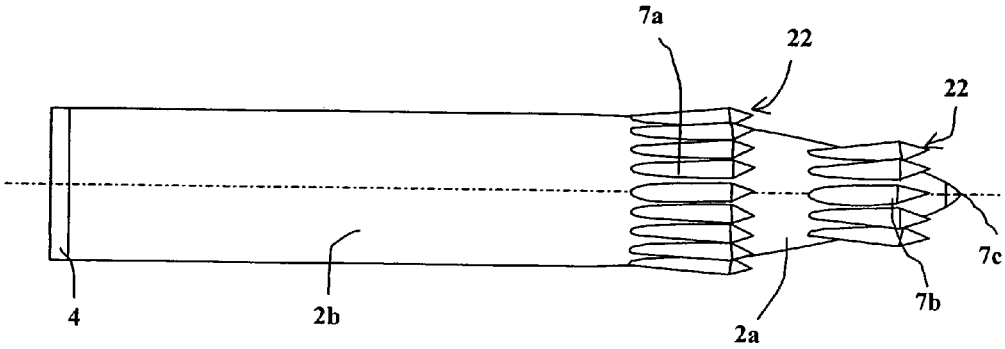

FIGS. 6*a* and 6*b* show another embodiment analogous to that of FIGS. 5*a* and 5*b*, but in which each bar 7*a* or 7*b* has its axis 23*a* or 23*b* inclined with respect to axis 21 of the penetration body 2.

Thus, the bars 7*a* of the external crown have an axis 23*a* inclined at an angle $\alpha$ of around 20° to 30°.

The bars 7*b* of the median crown have an axis 23*b* inclined at an angle $\beta$ of around 10° to 15°.

This arrangement also makes it easier for the front nose 2*a* to engage the target during an impact at an incidence.

With respect to the previous embodiment, this embodiment improves the engagement capabilities without increasing the mass or diameter of the bars 7.

Figure 7A:
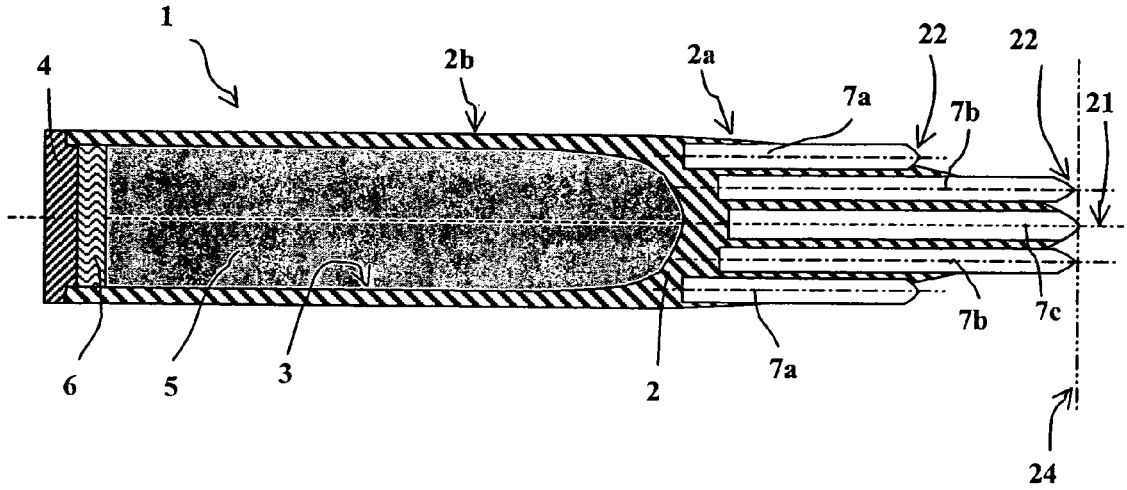
FIGS. 7*a* and 7*b* show longitudinal sections of two other embodiments of the ammunition according to the invention.

FIG. 7*a* shows another embodiment analogous to that of FIGS. 5*a* and 5*b* but in which the bars 7*b* of the median crown are of a length such that their nose 22 is substantially level with the nose 22 of the axial bar 7*c* (and thus in the same plane 24).

Such an embodiment provides for the simultaneous embrittlement of the target at several points of impact. Perforation is thereby improved.

Figure 7B:
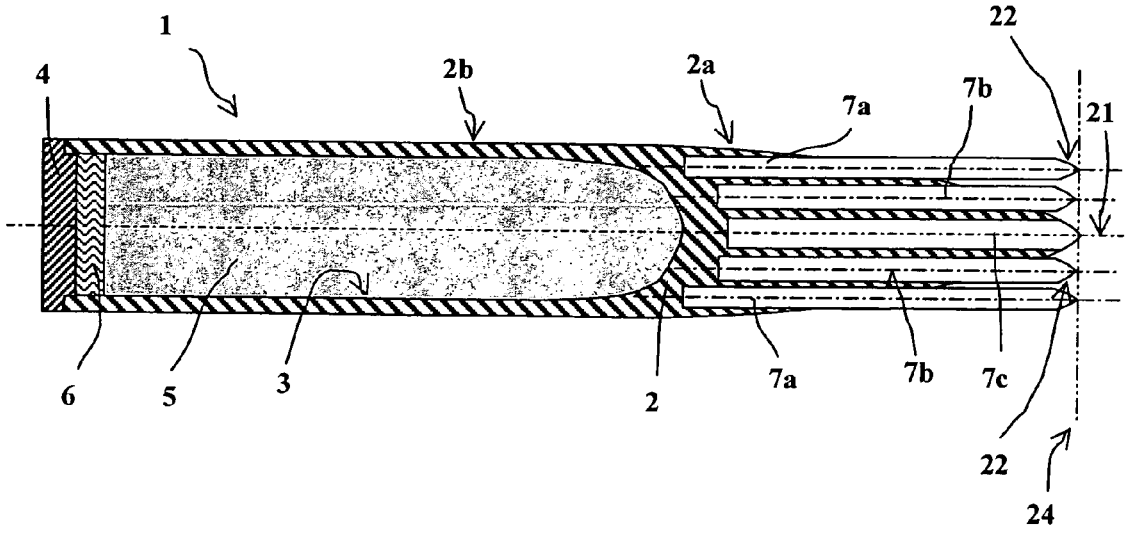

FIG. 7*b* shows an embodiment analogous to that of FIG. 7*a* but in which all the bars are of a length such that their nose 22 is substantially level with the nose 22 of the axial bar 7*c* (and thus in the same plane 24).

The number of simultaneous points of impact on the target is thus multiplied.

It would naturally be possible to similarly prolong the inclined bars such as shown in FIGS. 6*a* and 6*b*.

The ends of the bars of the external crown 7*a* and of the median crown 7*b* may be placed in the same plane whilst leaving the end of the bar 7*c* either retracted or protruding with respect to the crowns.

Other variants are also possible without departing from the scope of the invention.

It is thus possible for the embodiments in FIGS. 4*a* to 7*b* (multiple bars) to be combined with that in FIG. 3 (propelled bar).

A propellant charge may thus be provided enabling the axial bar 7*c* to be ejected before impact on the target. The other bars distributed on the crowns will remain fixed with respect to the front nose 2*a*.

The explosive charge 5 may also be replaced by a charge of a different nature, for example an incendiary charge or else one or several explosive and/or incendiary sub-munitions ejected after perforation of the target.

What is claimed is:

1. A perforating ammunition comprising a penetration body delimiting an internal cavity closed by a base, wherein said penetration body comprises a material having a limit of elasticity greater than or equal to 1,200 Mega Pascals and comprises a front nose comprising inserts integral with said nose, said inserts comprising a material with high mechanical properties, denser than that of said body and arranged in a housing opening to the outside of said body, where said inserts are arranged radially around an axial extension of said body, said inserts being integrally connected to said body by linking means.

2. A perforating ammunition according to claim 1, wherein said linking means comprises at least one ring surrounding the inserts.

3. A perforating ammunition according to claim 1 wherein said ammunition comprises a nose comprising a dense alloy located at the end of said axial extension of said body and having a rear surface pressing on said segments.

4. A perforating ammunition according to claim 1, wherein each of said inserts comprises a substantially cylindrical bar housed in a bore in said penetration body.

5. A perforating ammunition according to claim 4, wherein said ammunition comprises a single axial insert having a front nose extending said penetration body.

6. A perforating ammunition according to claim 5, wherein said ammunition comprises a propellant powder charge enabling said one insert to be ejected from said penetrating body.

7. A perforating ammunition according to claim 5, wherein said ammunition comprises at least one crown of bars evenly spaced around an axis of said penetration body.

8. A perforating ammunition according to claim 7, wherein said ammunition comprises two crowns of bars evenly spaced around an axis of said penetration body.

9. A perforating ammunition according to claim 7, wherein the ends of said bars are flush with an external surface of said penetration body.

10. A perforating ammunition according to claim 7, wherein the ends of said bars protrude from said penetration body.

11. A perforating ammunition according to claim 10, wherein each of said bars has its axis inclined with respect to the axis of the penetration body.

12. A perforating ammunition according to claim 8, wherein the ends of the bars of said crowns lie substantially in the same plane.

13. A perforating ammunition according to claim 1, wherein said internal cavity encloses at least one explosive charge.

* * * * *